US007285191B2

(12) United States Patent
Asakawa et al.

(10) Patent No.: US 7,285,191 B2
(45) Date of Patent: Oct. 23, 2007

(54) PHOSPHATE FILM PROCESSING METHOD AND PHOSPHATE FILM PROCESSING DEVICE

(75) Inventors: Hiroshi Asakawa, Tokyo (JP); Tetsuo Imatomi, Tokyo (JP); Naoyuki Kobayashi, Tokyo (JP); Shigemasa Takagi, Hashima (JP); Yoshihiro Fujita, Moriguchi (JP); Tokujiro Moriyama, Amagasaki (JP)

(73) Assignee: Fujisyoji Co.Ltd., Gifu (JP)

( * ) Notice: Subject to any disclaimer, the term of this patent is extended or adjusted under 35 U.S.C. 154(b) by 533 days.

(21) Appl. No.: 10/473,289

(22) PCT Filed: Mar. 26, 2002

(86) PCT No.: PCT/JP02/02907

§ 371 (c)(1),
(2), (4) Date: Feb. 5, 2004

(87) PCT Pub. No.: WO02/077328

PCT Pub. Date: Oct. 3, 2002

(65) Prior Publication Data

US 2004/0129209 A1 Jul. 8, 2004

(30) Foreign Application Priority Data

Mar. 27, 2001 (JP) ..... 2001-089150

(51) Int. Cl.

| | |
|---|---|
| ***C25D 17/00*** | (2006.01) |
| ***C25D 5/00*** | (2006.01) |
| ***C25D 9/08*** | (2006.01) |
| ***C25D 7/04*** | (2006.01) |
| ***C25D 11/00*** | (2006.01) |
| ***C25D 11/36*** | (2006.01) |

(52) U.S. Cl. ..... 204/199; 205/137; 205/151; 205/197; 205/318

(58) Field of Classification Search ..... 204/199; 205/137, 197, 316–333, 151
See application file for complete search history.

(56) References Cited

U.S. PATENT DOCUMENTS

| | | | | |
|---|---|---|---|---|
| 4,038,702 | A * | 8/1977 | Sawyer | 623/66.1 |
| 5,925,231 | A * | 7/1999 | Metzger | 205/127 |
| 6,235,180 | B1 * | 5/2001 | Kobayashi et al. | 205/141 |
| 6,679,980 | B1 * | 1/2004 | Andreacchi | 204/272 |

FOREIGN PATENT DOCUMENTS

| | | |
|---|---|---|
| JP | 3-202496 | 9/1991 |

OTHER PUBLICATIONS

Office Action in Korean-Patent Application No. 10-2003-7012638 mailed Aug. 1, 2005, 3 pages.
English Translation of the Office Action in Korean Patent Application No. 10-2003-7012638, 3 pages.

* cited by examiner

*Primary Examiner*—Roy King
*Assistant Examiner*—Nicholas A. Smith
(74) *Attorney, Agent, or Firm*—Osha Liang LLP

(57) ABSTRACT

A phosphate coating apparatus for depositing a phosphate coating on a metal material by electrolyzing the metal material in a predetermined electrolysis solution includes a positive electrode and a negative electrode, of which one electrode being disposed in contact with the metal material and the other electrode being disposed away from the metal material with a predetermined distance, and the other electrode being formed into a tubular shape so as to cover the entire length of the metal material.

5 Claims, 5 Drawing Sheets

PHOSPHATE FILM PROCESSING METHOD AND PHOSPHATE FILM PROCESSING DEVICE

FIELD OF THE INVENTION

This invention relates to a phosphate coating apparatus and a chemical conversion coating apparatus.

BACKGROUND OF THE INVENTION

A phosphate coating is generally deposited on the surface of a metal material so as to serve as a lubricating base for cold forging, a paint base or the like, but a phosphate coating is hard to be deposited on the surface of a stainless-steel material by a conventional immersion method. For this reason, in many cases, oxalate treatment is applied to a stainless-steel material so as to deposit an oxalate coating thereon. This oxalate coating, however, has a deteriorated property as comparison with a phosphate coating, and therefore there is a demand for a method of depositing a phosphate coating even on a stainless steel material. In consideration of this, the present applicants have developed a technique to deposit a phosphate coating on a stainless steel material by electrolysis treatment.

This electrolysis treatment enables deposition of a phosphate coating, but the applicants encountered another problem of the necessity to achieve uniform and high-speed deposition of a coating. This is a critical issue in light of the application of this technique to a manufacturing step in cold forging process, or the like.

Accordingly, it is an object of the present invention to provide a phosphate coating apparatus and a chemical conversion coating apparatus that are capable of achieving uniform and high-speed deposition of a coating.

SUMMARY OF THE INVENTION

The present inventors made an attempt to electrolyze (cathodic electrolysis in this case) a cylindrically shaped metal material W by disposing positive electrodes a each having a plate-like shape substantially parallel to each other respectively on the opposite sides of the metal material W, as viewed in cross section and holding the negative electrode β in contact with the metal material W, as illustrated in FIG. 5. However, it was difficult to produce uniform deposition of a phosphate coating, and also it was found that electrolyzation in a short period of time causes regions of the metal material W on which a coating is not formed. Such uncoated regions were found particularly on the upper and lower sides, and the opposite end surfaces of the metal material W.

Accordingly, the present inventors have conducted serious studies, which, as a result of the studies, leads to a discovery that a uniform coating can be deposited at high speed by entirely covering a metal material, and thus achieved the present invention.

According to the present invention, there is provided a phosphate coating apparatus for depositing a phosphate coating on a metal material by electrolyzing the metal material in a predetermined electrolysis solution comprising a positive electrode and a negative electrode, of which one electrode being disposed in contact with the metal material and the other electrode being disposed away from the metal material with a predetermined distance, and the other electrode being formed into a tubular shape so as to cover the entire length of the metal material.

Herein, by the tubular shape is meant not only a hollow cylinder shape but also a hollow rectangular column shape and any of those split in the circumferential direction. Also, by "cover the entire length of the metal material" is meant to cover the metal material in such a manner as to have no portion of the metal material protruding outward from an end of the tubular electrode. Therefore, covering the metal material with its opposite ends held respectively and substantially in flush with the opposite ends of the tubular electrode falls within the scope of the invention defined by this expression.

With the above arrangement having the electrode formed into a tubular shape so as to cover the entire length of the metal material, for a metal material having such as a cylinder shape, a phosphate coating is deposited uniformly over the entire circumference of the metal material. The tubular electrode, which covers the metal material, also can enhance the speed of deposition of a coating as compared with the plate-like electrodes as mentioned above.

Preferably, the other electrode, which is formed into a tubular shape, is the positive electrode and the one electrode, which is disposed in contact with the metal material, is the negative electrode so that cathodic electrolysis is performed. The arrangement with the one electrode, which is in contact with the metal material, functioning as the positive electrode for performing anodic electrolysis also enables high speed and uniform deposition of a coating, but poses a problem of causing sludge. On the contrary, the cathodic electrolysis is advantageous in the fact that it can limit generation of sludge.

Preferably, the electrode disposed in contact with the metal material provides a point contact with the metal material. The minimum contact area can result in more uniform deposition of a coating.

In another preferable arrangement, the other electrode is disposed substantially in horizontal orientation. The one electrode extends through a peripheral wall of the other electrode from the outside to the inside thereof and comes into contact with the metal material. The other electrode has an inner surface from which support members extend towards the center of the other electrode. The support members and the one electrode are arranged to hold the metal material substantially at the center of the other electrode.

With the tubular electrode disposed substantially in horizontal orientation, the one electrode in contact with the metal material is utilized to hold the metal material, thereby enabling the metal material to be securely held substantially at the center of the tubular electrode by a simple structure, and hence achieving more uniform deposition of a coating by holding the metal material substantially at the center.

In still another preferable arrangement, further provided is a rotational member having a rotational center shaft disposed substantially in horizontal orientation. The rotational member is disposed so as to have a predetermined lower region thereof immersed in the predetermined electrolysis solution. The other electrode comprises a plurality of second electrodes that are arranged with a predetermined spacing from each other on the rotational member and secured thereto. The one electrode comprises a plurality of first electrodes that are respectively arranged corresponding to the plurality of second electrodes. The rotational member is rotated so that the metal material in each of the plurality of second electrodes passes through the predetermined electrolysis solution during which a phosphate coating is deposited on the metal material.

With the above arrangement, metal materials, which are successively placed into the tubular electrodes, can be thrown into the electrolysis solution by the rotation of the rotational member in effective manner. That is, a large number of metal materials can be processed in a short time, thereby enabling the apparatus to be incorporated in such as one of the manufacturing steps of a production line equipped with a cold forging press machine, thus processing materials in a single process line. In addition, with the arrangement, in which the tubular electrodes are disposed substantially in horizontal orientation and each metal material is held by the one electrode and the support members, the metal materials can be securely held even during the rotation of the rotational member.

In another preferable arrangement, the plurality of first electrodes are negative electrodes and the plurality of second electrodes are positive electrodes. The negative electrodes respectively have distal ends that face downward when in the predetermined electrolysis solution and face upward when in a position outside of the predetermined electrolysis solution Since the distal ends of the negative electrodes face upward when in a position outside of the predetermined electrolysis solution, the electrolysis solution attached on the negative electrodes flows downwards from the distal ends so that the electrolysis solution remaining on the distal ends can be limited. Accordingly, it is not necessary to remove a thin coating, which may be deposited on the distal end of each negative electrode due to the electrolysis solution remaining thereon, by such as polishing in a separate step, thus omitting a troublesome work as well as an additional arrangement therefore.

According to the present invention, there is provided a chemical conversion coating apparatus for applying a chemical conversion coating to a metal material by electrolyzing the metal material in a predetermined electrolysis solution comprising a positive electrode and a negative electrode, of which one electrode being disposed in contact with the metal material and the other electrode being disposed away from the metal material with a predetermined distance, and the other electrode being formed into a tubular shape so as to cover the entire length of the metal material.

Herein, as examples of the chemical conversion coating, it can be cited an oxalate coating, aluminum fluoride coating, copper oxide coating and titanium fluoride coating, as well as a phosphate coating. These chemical conversion coatings can also be uniformly formed at high speed.

As described above, the electrode, which is disposed away from the metal material with a predetermined distance, is formed into a tubular shape so as to cover the entire length of the metal material, can contribute to uniform and high-speed deposition of a phosphate coating as well as a chemical conversion coating.

DETAILED DESCRIPTION OF THE PREFERRED EMBODIMENTS

Figure 2:
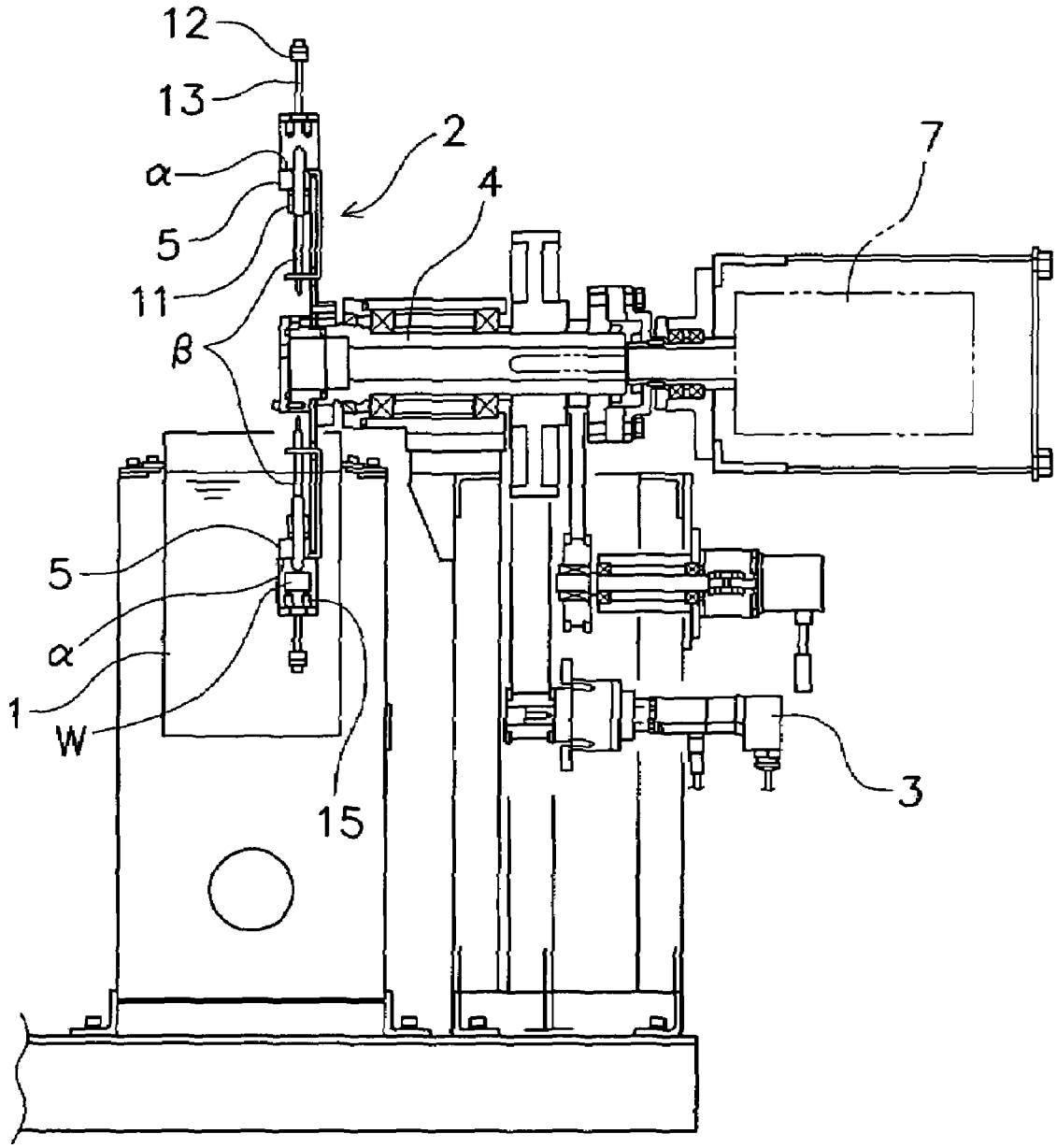
FIG. 2 is a schematic side view in cross section of the apparatus.

An embodiment of a phosphate coating apparatus of the present invention will be hereinafter described with reference to the drawings. In FIG. 2, cross-hatching is omitted.

While a metal material on which a coating is deposited may have a varying shape, the following description will be made by taking for example a billet made by cold forging and more particularly a billet having a stepped cylinder shape as a metal material to be processed. Herein, by the billet is meant the one having a cylindrical, rectangular column, hollow cylinder or hollow rectangular column shape having a predetermined length.

The phosphate coating apparatus of this embodiment includes an electrolysis vessel 1 with a predetermined electrolytic solution therein, and a rotational plate 2 as a rotational member disposed so as to have a predetermined lower region thereof immersed in the electrolysis vessel 1.

Herein, various electrolytic solutions may be employed as the electrolytic solution used in this embodiment. For example, it is possible to employ a phosphate treatment solution containing zinc ion, phosphate ion and nitrate ion, and more preferably at least one metal ion selected from magnesium, aluminum, calcium, manganese, chromium, iron and nickel. More specifically, it is preferable to contain 20-50 g/L of zinc ions, 20-70 g/L of phosphate ions and 30-80 g/L of nitrate ions, and more preferable to contain an oxidizer such as nitrous acid ions, hydrogen peroxide and chloride ions in a phosphate treatment solution.

The thickness of a coating is determined by the density, temperature or the like of a treatment solution, current density and treatment time. The temperature of the treatment solution is preferably from room temperature to 80° C., and the current density is preferably in the range of 20-100 $A/dm^2$.

On the other hand, as illustrated in FIG. 2, above the electrolysis vessel 1 is disposed a rotational center shaft 4, which is extended substantially in horizontal orientation to receive a drive force from a motor 3, and has a first end with the rotational plate 2 coaxially and integrally fixed thereto.

Figure 1:
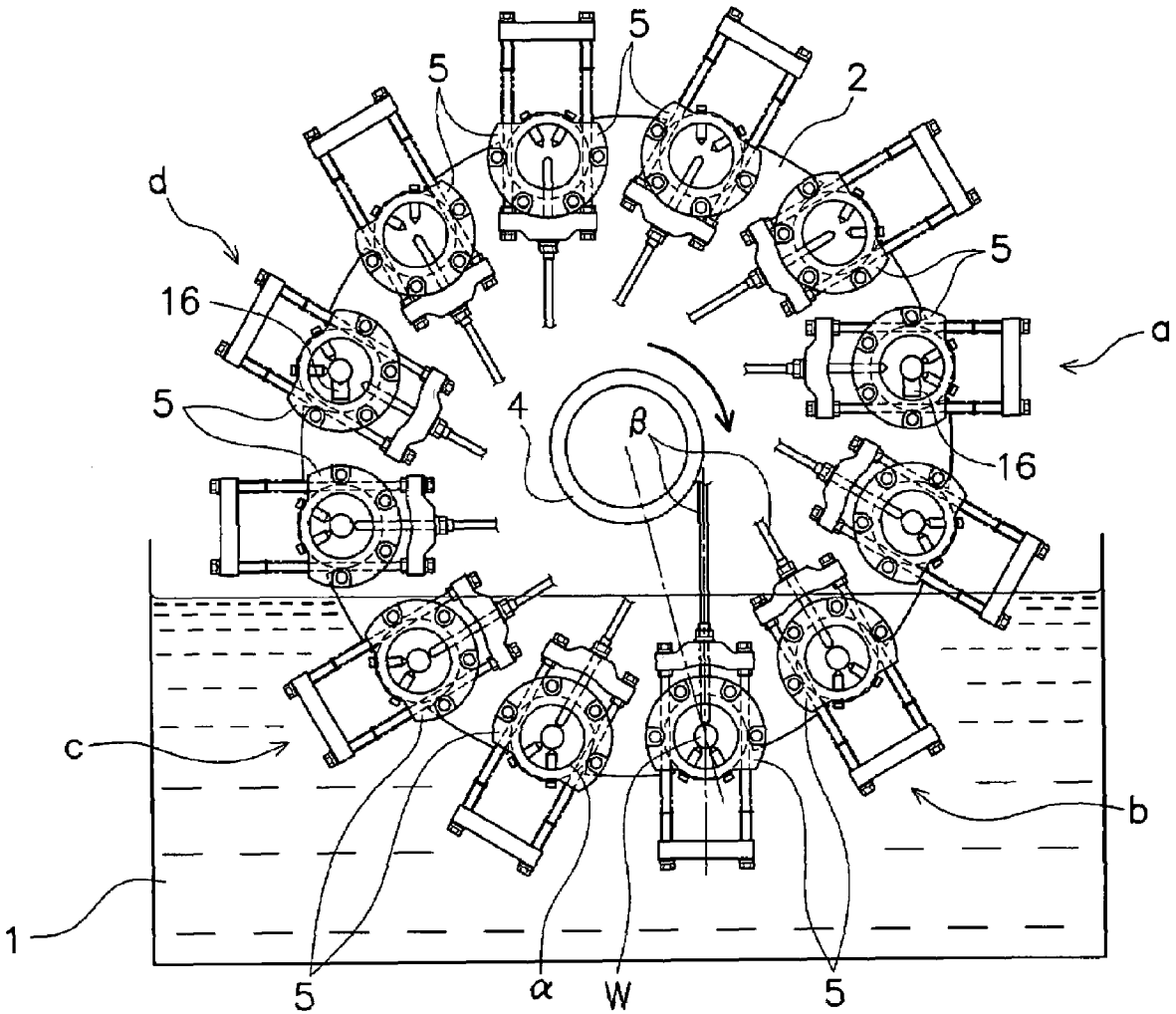
FIG. 1 is a schematic front view of a phosphate coating apparatus according to one embodiment of the present invention.
Figure 3:
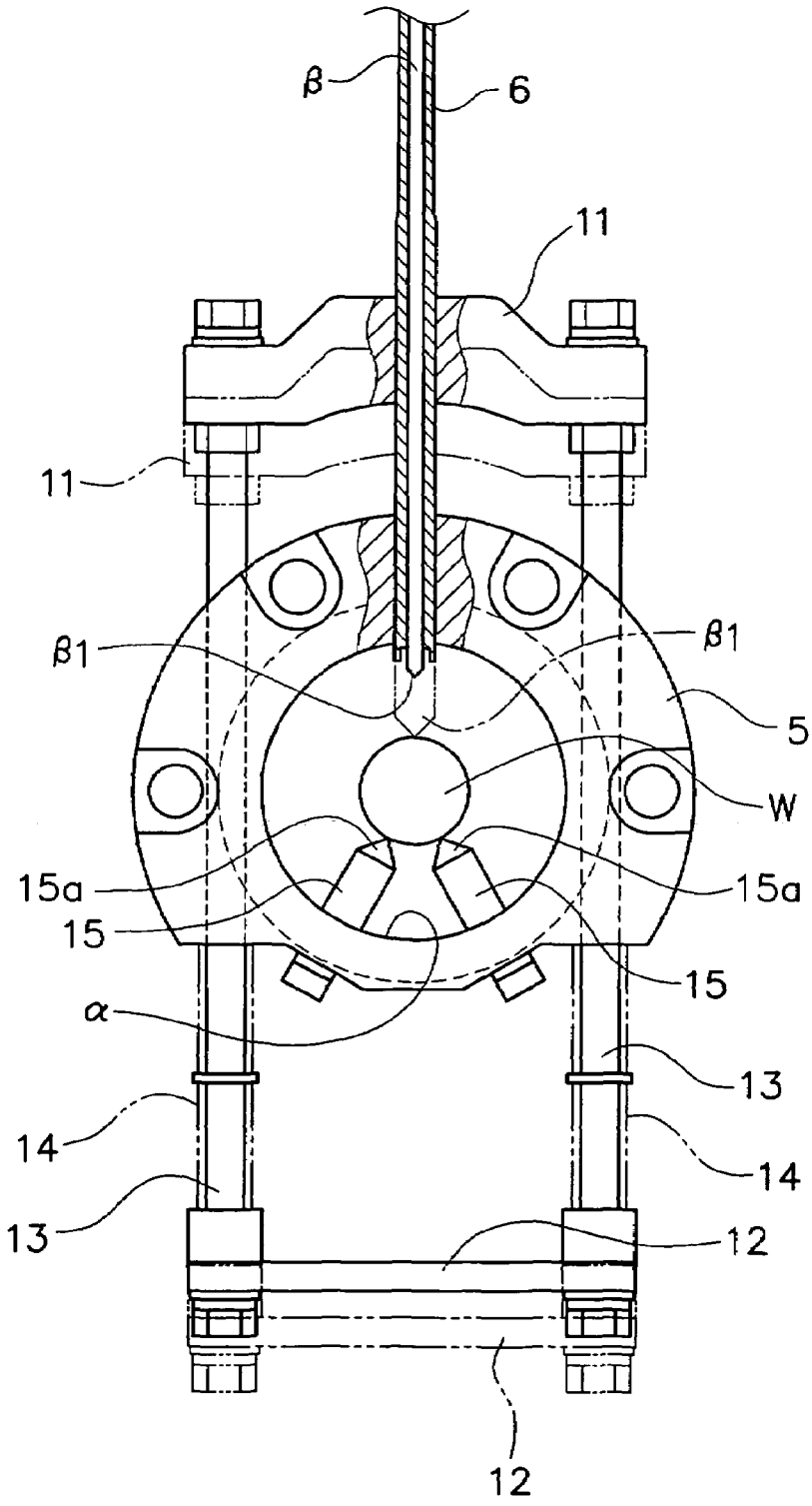
FIG. 3 is an enlarged, partially cross sectional view of an essential portion of the apparatus.
Figure 4:
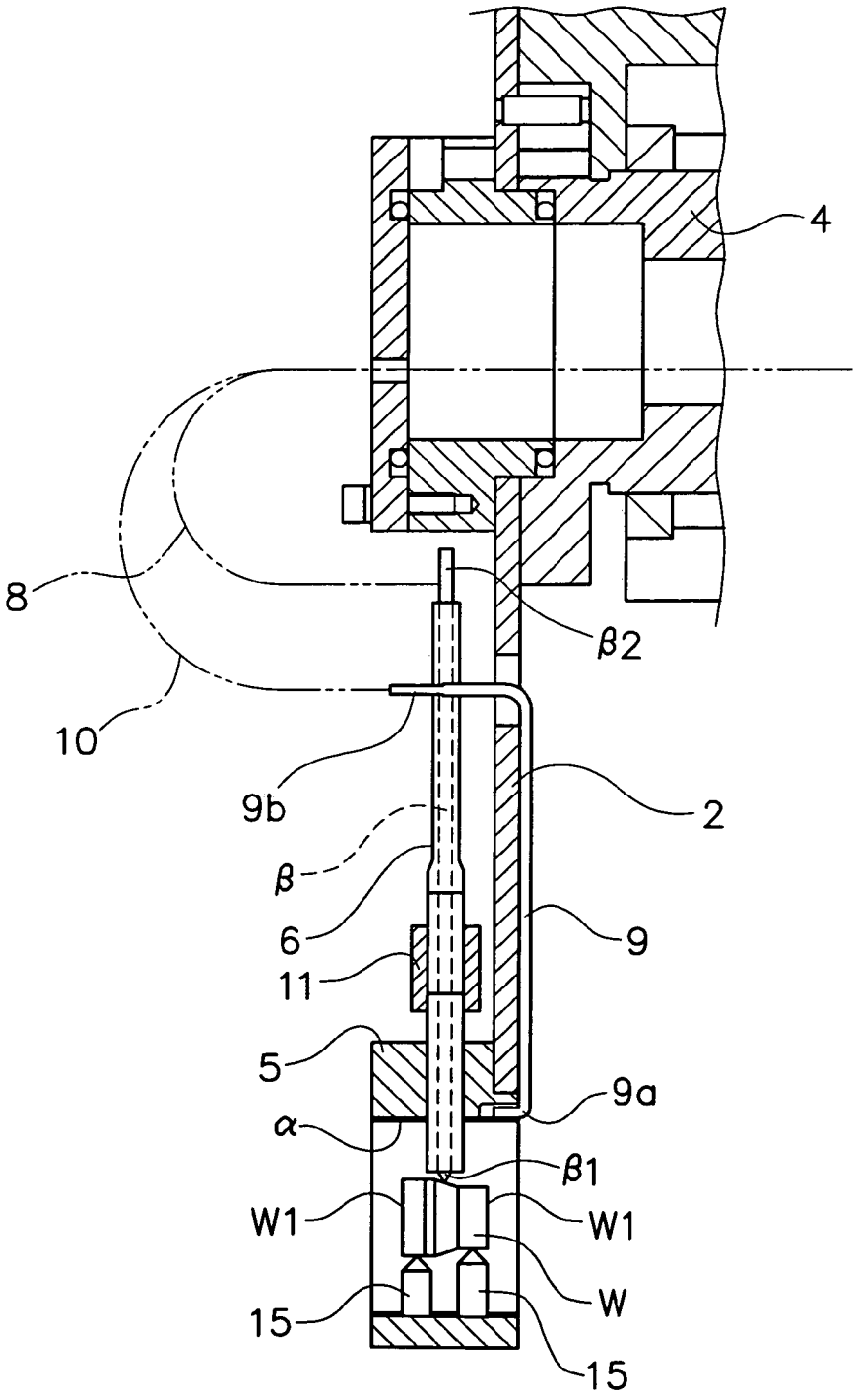
FIG. 4 is a partially enlarged view of FIG. 2.

The rotational plate 2 has a circumferential part, to which plural electrode frames 5 are fixedly arranged with predetermined spacing therebetween in the circumferential direction of the rotational plate 2. Specifically, as illustrated in FIG. 1, twelve electrode frames 5 in total are fixedly arranged on the same circle with an angular spacing of 30 degrees. Herein, it is to be noted that the spacing, number and the like of the electrode frames 5 are not necessarily limited to specific ones as mentioned. With this arrangement, the rotational plate 2 is intermittently rotated by every 30 degrees by the control of the motor. The electrode frames 5 each have in its substantially center a circular through hole extending in the fore and aft direction with its axis substantially parallel to the rotational center shaft 4, thus giving each electrode frame a hollow shape in its entire appearance, as illustrated in FIGS. 3 and 4. The electrode frames 5 are made of an insulating material such as plastic, and each have a positive electrode $\alpha$ having a hollow cylinder shape secured to an inner circumference thereof. That is, in this embodiment, the positive electrode $\alpha$ is formed into a hollow cylinder shape and mounted substantially in horizontal orientation to the rotational plate 2 via the corresponding electrode frame 5.

While the size of each positive electrode $\alpha$, which was formed into a tubular shape, depends on the entire length, diameter or the like of a billet W to be coated, it must have a length enough to cover the entire length of the billet W. The entire length of the positive electrode α may be set substantially equal to the entire length of the billet W so that opposite ends W1 of the billet W are respectively and substantially flush with opposite ends α1 of the positive electrode α. However, it is necessary to prevent the billet W from protruding away from any one of the opposite ends α1 of the positive electrode α.

The positive electrode α is formed by using a titanium thin plate having a thickness of about 0.5 mm and has a platinum plated inner surface. For electrodes as well as negative electrodes β (hereinafter described), it is possible to use such as carbon, stainless steel, platinum, titanium alloy and titanium-platinum coated alloy (common name: DSE). Metal ions can be successively supplied by using the same kind of metal as metal ions contained in an electrolytic solution, provided that the solution control is made so as to maintain the metal ions contained in the electrolytic solution at a constant amount.

Now, the description will be made for a means of holding each billet W substantially at a position corresponding to the cross sectional center of the positive electrode α. As illustrated in FIGS. 3 and 4, each negative electrode β having a round bar shape is disposed in each electrode frame 5 and extended through peripheral walls of the electrode frame 5 and the positive electrode α. The negative electrode β is covered by a sleeve 6 made of a insulating material such as plastic and formed into a tubular shape. The negative electrode β has a distal end β1 formed with a sharp point and protruding away from an end of the sleeve 6. This distal end β1 is designed to provide a point contact with the circumference of the billet W. The negative electrode β also has a proximal end β2 connected to a slip ring 7, which is mounted on a second end of the rotational center shaft 4, with a wire 8 that passes through the inside of the hollow rotational center shaft 4 in the axial direction.

The negative electrode β is slantingly disposed relative to a line segment joining the center of the rotational center shaft 4 and the center of the positive electrode α by a predetermined angle (15 degrees in this embodiment), as viewed from the front side (in the axial direction), as illustrated in FIG. 1.

On the other hand, as illustrated in FIG. 4, a titanium rod 9 is welded at its distal end 9*a* to the outer circumference of the rear end side of the positive electrode α. The titanium rod 9 extends on the rear side of the rotational plate 2 towards the rotational center shaft 4, has an end passing through the rotational plate 2 in proximity to the rotational center shaft 4 and is provided with a heat shrinkable tube that covers the titanium rod over its entire length. A proximal end 9*b* of the titanium rod 9 is connected to the slip ring 7 with a wire 10 in the same manner as the negative electrode β. As illustrated in FIG. 1, the control is made so that electricity is turned on only during both electrodes α and β are located between a position "b" and a position "c". That is, the electricity is turned on at the position "b" and turned off at the position "c".

On the other hand, in FIGS. 3 and 4, the negative electrode 8 is arranged in such a manner as to be capable of moving back and forth in the radial direction of the tubular positive electrode α. Specifically, the negative electrode β is fixed in position within an inner base 11 located on the inner side of the electrode frame 5, and the inner base 11 is connected to an outer base 12 located on the outside of the electrode frame 5 with a pair of connection rods 13. The bases 11, 12 are both made of an insulating material such as plastic. Coil springs 14 are respectively mounted on the connection rods 13 between the outer base 12 and the electrode frame 5. The outer base 12 is thus urged outward by these coil springs 14, enabling the inner base 11 and the negative electrode β to be urged outward as well. That is, the negative electrode β is urged towards the center of the positive electrode α by the coil springs 14 as urging means.

As illustrated in FIG. 3, support pins 15 made of an insulating material such as plastic extend away from the inner circumference of the positive electrode α towards the center to serve as support members. The support pins 15 each have a distal end formed with a sharp point to provide a point contact with the circumference of the billet W. The support pins 15 are mounted to the inner surface of the electrode frame 5 by bolts and extend through the positive electrode α in the radial direction. As illustrated in FIG. 3, two pairs of the support pins 15, each pair being disposed at a predetermined angle relative to each other as viewed in the axial direction of the positive electrode α, are provided away from each other in the axial direction, as illustrated in FIG. 4, thus providing four support pins in total. The support pins 15 are located on the opposite side of the negative electrode β. That is, with the rotational plate 2 as a reference, the negative electrode β is located closer to the center of the rotational plate 2 and the support pins 15 are located relatively closer to the outer circumference of the rotational plate 2. The billet W is thus clamped in the radial direction of the positive electrode α by the negative electrode β and the plural support pins 15. This clamping force results from the spring force of the coil springs 14 as the urging means. Thus, the negative electrode β and plural support pins 15 together make up a means for holding the billet W substantially at the center of the positive electrode α. The negative electrode β as illustrated is held in a state enabling clamping the billet W in cooperation with the support pins 15 while being constantly urged towards the center of the positive electrode α. The negative electrode β is released from the clamping state by an air cylinder (not shown). In FIG. 3, those parts in a clamp releasing state are illustrated in solid line and those in a clamping state are illustrated in chain double-dashed line.

In FIG. 1, the position "a" represents a position at which the billet W is thrown into the positive electrode α, and the position "d" represents a position at which the billet W subjected to the film forming process is discharged from the positive electrode α. The billet W is thrown into the positive electrode α, from the front side of the rotational plate 2 and discharged therefrom to the front side of the rotational plate 2. The air cylinder is activated only for the billet W at these throw-in and discharge positions a, d so as to bring the negative electrode β into a withdrawn state, thereby releasing the same from the clamping state. The air cylinder is not activated for the billet W during it is located at any positions other than the positions a, d so that the negative electrode β is held in a projecting state by the urging force of the coil springs 14, thereby enabling the billet W to be clamped during the travel from the throw-in position "a" to the discharge position "d".

At the time of throw-in, the air cylinder is activated to hold the negative electrode β in the withdrawn state. At the throw-in position "a", the negative electrode β and the support pins 15 are located substantially on the right and left hand sides so that the billet W is placed on a support base 16 having a V-shaped upper surface and then inserted into the positive electrode α along with the support base 16 from the front side of the positive electrode α. Then, the air cylinder is stopped to bring the negative electrode β into the projecting state by the spring force of the coil springs 14 to clamp the billet W. After that, only the support base 16 is withdrawn from the positive electrode α in the axial direction.

In the discharging operation, the support base 16 is inserted into the positive electrode α and located below the billet W, and then the air cylinder is activated to withdraw the negative electrode β and place the billet W on the support base 16. Then, the support base 16 along with the billet W are withdrawn from the inside of the positive electrode α to the front side.

The negative electrode β is arranged closer to the center than the electrode frame 5 so that the distal end β1 of the negative electrode β faces downward when in the electrolytic solution and upward when in a position outside of the electrolytic solution.

Figure 5:
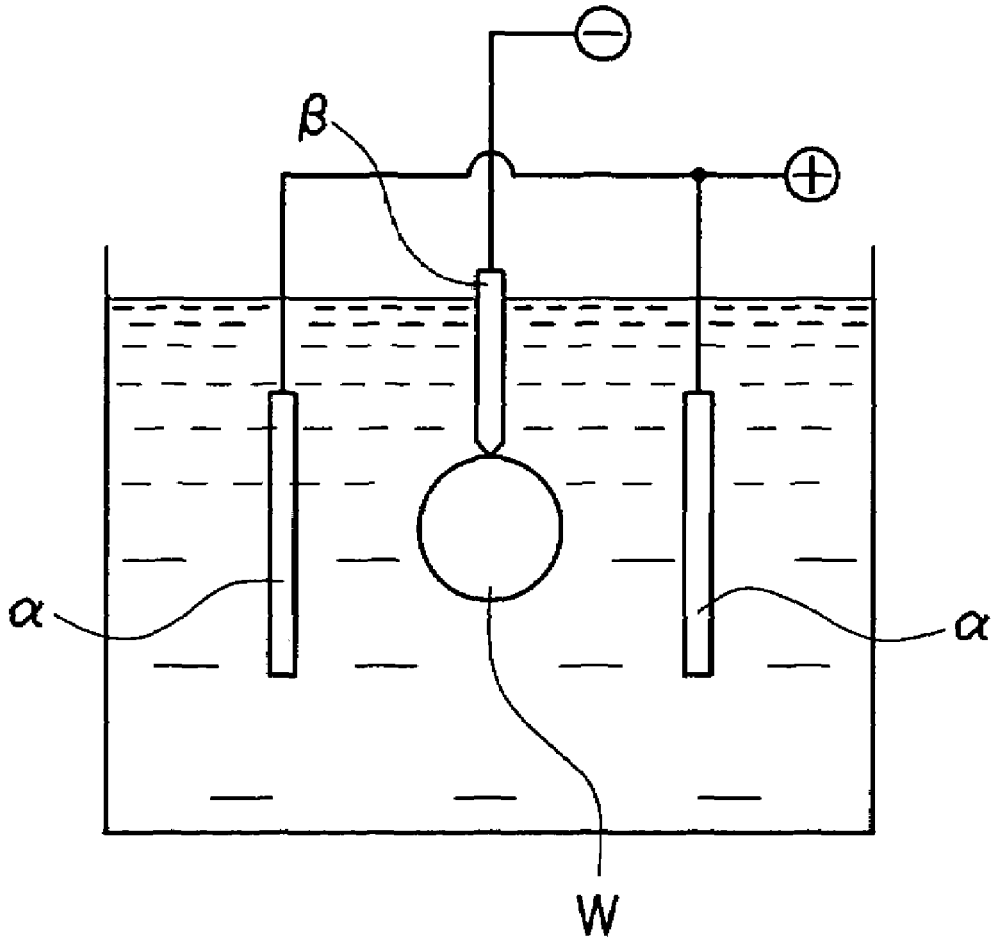
FIG. 5 is a schematic explanatory view of a conventional apparatus.

In the thus arranged apparatus, the positive electrode α is formed into not a plate like shape as illustrated in FIG. 5, but a hollow cylinder shape so that a phosphate coating is uniformly deposited on the entire circumference of the billet W. In addition, since the positive electrode α covers the entire length of the billet W, the coating is uniformly deposited also on the end surfaces of the billet W. The positive electrode α thus formed into a hollow cylinder shape and arranged so as to cover the entire length of the billet W enables a coating to be uniformly formed at high speed. Particularly, as in this embodiment, holding the billet W substantially at the center of the positive electrode α provides more uniform deposition of a coating.

The point contact of the distal end β1 of the negative electrode β and the point contact of each support pin 15 with the billet W also contribute to the uniform deposition of a coating.

On the other hand, in this embodiment, cathodic electrolysis, which is achieved by making the negative electrode β serve as an electrode to contact the billet W, can limit generation of sludge, while it is also possible to achieve anodic electrolysis by making the positive electrode α contact the billet W. With this anodic electrolysis, a coating can also be uniformly deposited at high speed.

The arrangement that makes the negative electrode β, which contacts the billet W, serve as the holding means, achieves a simplified structure of the holding means and hence enables the entire apparatus to have a simplified structure.

In the thus arranged apparatus, the billets W are successively thrown into the positive electrodes α at the throw-in position "a" and then pass through the electrolysis solution by the rotation of the rotational plate 2. The electricity is turned on during the billet W travels from the position "b" to the position "c", during which a coating is deposited on the billet W. Then, the thus coated billets W are successively discharged at the discharge position "d", and then transferred to a downstream process.

With the arrangement having the plural positive electrodes α mounted on the rotational plate 2, the billets W can be successively thrown into the electrolysis solution by the utilization of the rotation of the rotational plate 2 and subjected to the coating deposition process. That is, the apparatus of this embodiment, which utilizes the rotation of the rotational plate 2, can allow a large number of the billets W to be successively subjected to the coating deposition process in a short interval of time. Accordingly, the coating deposition process suitable for the processing capability of a press machine can be made by arranging this apparatus in a series of steps of a production line leading to the press machine.

It will be appreciated that while the support pins 15 are disposed on the outer circumferential side of the rotational plate 2 and the negative electrode β is disposed on the center side of the rotational plate 2 in this embodiment, it is still possible to employ the reverse arrangement. However, the arrangement with the negative electrode β disposed on the center side of the rotational plate 2 allows the distal end β1 of the negative electrode β to face upwards when in a position outside of the electrolysis solution, with the result that the electrolysis solution attached on the negative electrode β flows from the distal end β1 downwardly towards the proximal end β2. If a large amount of the electrolysis solution is left on the distal end β1 of the negative electrode β, a thin coating is likely to be deposited on the distal end β1, which results in the necessity to undertake an additional work of finely polishing the distal end β1. This accordingly requires a polishing mechanism, which causes the apparatus to have a complicated structure. Therefore, the upward orientation of the distal end β1 when in a position outside of the electrolysis solution can omit the troublesome work of polishing the distal end β1 of the negative electrode β and an additional arrangement therefore, while requiring only simple polishing, even if polishing is necessitated.

The positive electrode α, which is formed into a hollow cylinder shape, may be formed into a hollow cylinder shape having an elliptical cross section or an angled hollow column having a polygonal cross section. Moreover, the hollow cylinder shape as intended may have a discontinuous shape in the circumferential direction such as a hollow cylinder split into two or three sections. Also, the positive electrode α is not necessarily to have a continuous shape in the axial direction and therefore is possible to be formed into a meshed cylinder.

While the above description was made by taking for example the case where a phosphate treatment solution as an electrolysis solution is placed in the electrolysis vessel 1 and the billets W made of stainless steel are to be processed by the phosphate coating apparatus, it is still possible to place a different treatment solution such as an oxalate treatment solution in the electrolysis vessel 1, allowing the apparatus to be used as an oxalate coating apparatus or other chemical conversion coating apparatus. In either case, it is also possible to provide uniform high-speed deposition of a coating. Therefore, the material of the billet W is not limited only to stainless steel, but various materials such as carbon steel, chrome steel, chromium-molybdenum steel, nickel-chromium steel, nickel-chromium-molybdenum steel, boron steel, manganese steel, other iron and steel materials, non-ferrous materials such as aluminum, magnesium, titanium and copper, and various conductive materials can be used.

It will be appreciated that while in the above embodiment, the positive electrode α having a hollow cylindrical shape is disposed substantially in horizontal orientation, it may be disposed substantially in vertical orientation. However, the positive electrode α substantially in horizontal orientation is advantageous in the fact that the billet W can be securely held by a simple structure.

It will be also appreciated that while the negative electrode β is utilized as a means for holding the billet W, a holding member made of an insulating material may be separately provided as an alternative to the utilization of the negative electrode β.

While the rotational plate 2 having a disk shape is used as the rotational member, it is possible to employ a rotational member made up of plural spokes extending radially from the rotational center shaft 4, or modify the rotational member to be properly adapted to each application. It is a matter of course that not only a so-called rotary type arrangement with using the rotational member but also any other arrangements such as an arrangement enabling the deposition of coating by immersing the billet W in an electrolysis solution for a predetermined time by moving the billet W upward and downward while holding the same can be employed. Although mentioned above, the negative electrode β and members on this side may be formed into a hollow cylinder shape. In either arrangement, by forming the one of the negative and positive electrodes, which is disposed away from the billet with a predetermined distance while avoiding contact with the billet W, into a hollow cylinder shape so as to cover the entire length of the billet W, it is possible to achieve uniform and high-speed deposition of a coating.

The invention claimed is:

1. A phosphate coating apparatus for depositing a phosphate coating on a metal material by electrolyzing said metal material in a predetermined electrolysis solution comprising a positive electrode and a negative electrode, of which one electrode being disposed in contact with said metal material and the other electrode being disposed away from said metal material with a predetermined distance, and said other electrode being formed into a tubular shape so as to cover the entire length of said metal material, wherein said other electrode is disposed substantially in horizontal orientation, said one electrode extends through a peripheral wall of said other electrode from the outside to the inside thereof and comes into contact with said metal material, said other electrode has an inner surface from which support members extend towards the center of said other electrode, and said support members and said one electrode are arranged to hold said metal material substantially at the center of said other electrode.

2. The phosphate coating apparatus according to claim 1, wherein said one electrode is said negative electrode and said other electrode is said positive electrode.

3. The phosphate coating apparatus according to any one of claims 1 and 2, wherein said one electrode provides a point contact with said metal material.

4. The phosphate coating apparatus according to claim 1 further comprising a rotational member having a rotational center shaft disposed substantially in horizontal orientation, said rotational member being disposed so as to have a predetermined lower region thereof immersed in the predetermined electrolysis solution, said other electrode comprising a plurality of second electrodes that are arranged with a predetermined spacing from each other on said rotational member and secured thereto, and said one electrode comprising a plurality of first electrodes that are respectively arranged corresponding to said plurality of second electrodes, in which said rotational member is rotated so that said metal material in each of said plurality of second electrodes passes through the predetermined electrolysis solution during which a phosphate coating is deposited on said metal material.

5. The phosphate coating apparatus according to claim 4, wherein said plurality of first electrodes are negative electrodes and said plurality of second electrodes are positive electrodes, said negative electrodes respectively having distal ends that face downward when in the predetermined electrolysis solution and face upward when in a position outside of the predetermined electrolysis solution.

* * * * *